US011090830B2

(12) United States Patent
Herrmann

(10) Patent No.: US 11,090,830 B2
(45) Date of Patent: Aug. 17, 2021

(54) GUTTER CENTERED DIE-CUT FOR IMPROVED SEPARATION OF ADHESIVE SIGNAGE

(71) Applicant: XEROX CORPORATION, Norwalk, CT (US)

(72) Inventor: Douglas K Herrmann, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 236 days.

(21) Appl. No.: 15/915,451

(22) Filed: Mar. 8, 2018

(65) Prior Publication Data

US 2019/0275693 A1 Sep. 12, 2019

(51) Int. Cl.

| | |
|---|---|
| ***B26D 9/00*** | (2006.01) |
| ***B26D 1/62*** | (2006.01) |
| ***B31D 1/02*** | (2006.01) |
| ***B26D 7/18*** | (2006.01) |
| ***B26D 11/00*** | (2006.01) |

(52) U.S. Cl.

CPC ..... *B26D 9/00* (2013.01); *B26D 1/626* (2013.01); *B26D 7/18* (2013.01); *B31D 1/021* (2013.01); *B31D 1/026* (2013.01); *B26D 2011/005* (2013.01); *B31D 2201/02* (2013.01)

(58) Field of Classification Search

CPC . Y10T 83/6491; Y10T 83/02; Y10T 83/0207; Y10T 83/0215; Y10T 83/7688; Y10T 83/0524; Y10T 83/6478; B26D 11/00; B26D 11/005; B26D 1/245; B26D 7/2635; B26D 1/626; B26D 7/18; B26D 9/00; B31D 1/021; B31D 1/026; B31D 2201/02

USPC ..... 83/886, 39, 408, 44, 861–865, 688, 660, 83/25, 33, 371

See application file for complete search history.

(56) References Cited

U.S. PATENT DOCUMENTS 2,095,437 A * 10/1937 Fox ..... G09F 3/10 40/638
3,224,306 A * 12/1965 Hawley ..... B26D 11/00 83/23
3,706,626 A * 12/1972 Smith ..... G09F 3/10 428/42.3
3,892,901 A * 7/1975 Smith ..... B26D 9/00 428/42.2
3,958,051 A * 5/1976 Smith ..... B26D 9/00 428/42.3
4,405,121 A * 9/1983 Hill ..... B65H 39/00 270/58.33
5,397,106 A * 3/1995 Hill ..... B65H 35/02 270/58.34
5,777,879 A * 7/1998 Sommerfeldt ..... B26D 5/32 226/27
6,837,957 B2 * 1/2005 Flynn ..... B41J 3/4075 156/252
6,860,050 B2 * 3/2005 Flynn ..... G09F 3/10 283/81
8,302,338 B2 11/2012 Engelby et al.

(Continued)

*Primary Examiner* — Laura M Lee
(74) *Attorney, Agent, or Firm* — William A. Henry

(57) ABSTRACT

A process for cutting column and row gutters on multilayer signage media into individualized signage cards includes placing pre-die-cut slits at predetermined locations within the column gutters to assist a cutter in cutting completely through the multilayer signage media.

7 Claims, 5 Drawing Sheets

(56) References Cited

U.S. PATENT DOCUMENTS

| | | | | |
|---|---|---|---|---|
| 8,555,759 | B2 * | 10/2013 | Caughey, Jr. | G07F 11/68 83/242 |
| 8,701,535 | B2 * | 4/2014 | Endo | B26D 1/245 |
| 9,561,597 | B2 * | 2/2017 | Endo | B26D 7/2635 |
| 10,022,883 | B2 * | 7/2018 | Herrmann | B26D 7/18 |
| 2003/0097916 | A1 * | 5/2003 | Petersen | B26D 5/34 83/35 |
| 2003/0217628 | A1 * | 11/2003 | Michalski | B26D 7/20 83/425 |
| 2009/0320660 | A1 * | 12/2009 | Gwosdz-Kaupmann | B65H 23/046 83/40 |
| 2013/0192439 | A1 * | 8/2013 | Endo | B26D 1/245 83/425.2 |
| 2015/0273720 | A1 * | 10/2015 | Endo | B26D 1/245 83/425.1 |
| 2019/0275693 | A1 * | 9/2019 | Herrmann | B26D 9/00 |

* cited by examiner

GUTTER CENTERED DIE-CUT FOR IMPROVED SEPARATION OF ADHESIVE SIGNAGE

Cross-referenced and included herein by reference is commonly assigned U.S. application Ser. No. 15/358,317, US01, filed Nov. 22, 2016, now U.S. Pat. No. 10,022,883, and entitled SEQUENTIAL DIE-CUT AND SLITTING FOR IMPROVED COLLATION by Douglas K. Herrmann et al.

BACKGROUND

The present disclosure relates to a process of cutting adhesive signage for store shelving, and more particularly, to an improved method for cutting sheets of multilayer substrates into individualized signage members.

A general background for marketing signage for in-store shelving can be found in U.S. Pat. No. 8,302,338, but the current process being used to create adhesive signage for store shelving involves a multilayer adhesive substrate that includes a very robust polymer carrier along with paper and adhesives that make the substrate difficult to cut.

Multilayer substrates currently used are fully backed media consisting of five layers: 1) a top printable paper; 2) a permanent adhesive; 3) a polymer carrier; 4) a pressure sensitive adhesive; and 5) a release liner. The multilayer adhesive substrates add needed strength and can be cut into predetermined sized cards for store shelving through cutting column and row gutters on the substrates, but gutter cutting issues can be experienced when any of the materials or cutting equipment varies from their optimal nominal states, for example, thicker carrier, thicker paper, more adhesive, dulling blades, blade spacing, etc. In addition, cutting difficulties can be experienced when in-line column secondary cuts are made into the substrates through primary orthogonal cuts already made in the substrates because stress concentration points are encountered at locations where the secondary cuts cross the primary cuts creating stress concentration points that are difficult to cut cleanly. As a result of the heretofore-mentioned cutting difficulties, some cards can remain adhered to the adjacent gutter after the cutting operation leaving the gutter not fully separated from a card which can lead to machine jams.

Obviously, there is a need for an improved process for cutting polymer lined fully backed adhesive signage stock for store shelving while simultaneously ensuring that a card where a secondary cut is initiated separates from an adjacent card.

SUMMARY

Accordingly, an answer to this need is disclosed herein that incorporates a two-step cutting method to ensure that the polymer carrier is slit and the cards are separated from column gutters effectively prior to being transported into a collection tray. A pre-die-cut slit is first placed at the bottom of each card creating a stress concentration point in the column gutter in order to back up a blade initiated portion of the cut. A blade cut is then initiated into gutter columns of the polymer carrier and if the blade fails to initiate a clean cut at the bottom of a card, the pre-die-cut slit will ensure that there is still a full separation of the card and gutter at the pre-die-cuts. Without this pre-die-cut system of slits, the gutter cut initiation will be at risk as media and cutting parameters migrate away from nominal and as stress concentration points are encountered. And with the pre-die-cut slit arrangement, the gutter cut initiation and card/gutter separation is ensured.

BRIEF DESCRIPTION OF THE DRAWINGS

Various of the above-mentioned and further features and advantages will be apparent to those skilled in the art from the specific article or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
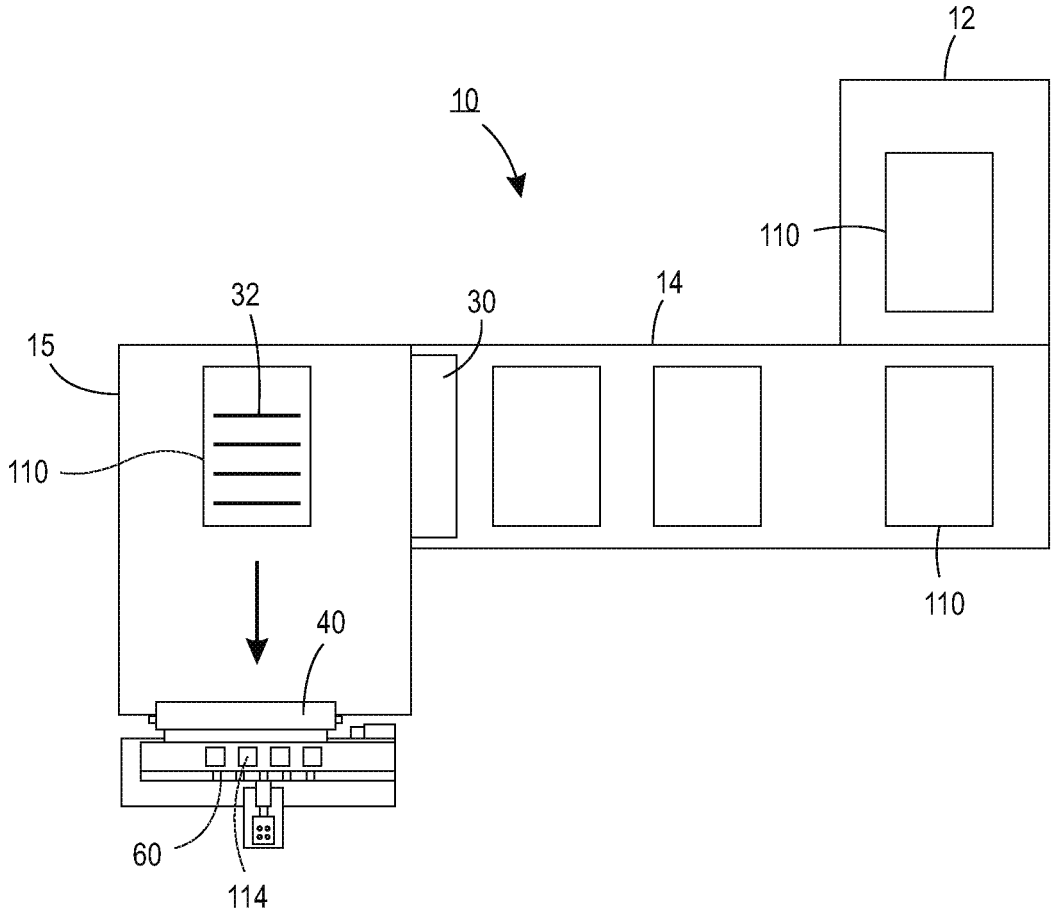
FIG. 1 is a plan view of a card collection system.

For a general understanding of the features of the disclosure, reference is made to the drawings. In the drawings, like reference numerals have been used throughout to identify identical elements.

In FIG. 1 a card collection system 10 is shown in which card images printed on substrate 110 are outputted from a printer 12 onto a conveyor 14 positioned lengthwise and forwarded into an articulating slitter 30 that is movable between cutting and non-cutting positions. In the cutting position slitter 30 places slits 32 across a portion of card sheets 110 and conveyor 15 conveys the sheets into a second stationary cutter 40 which then cuts the card sheets into individual cards 114 and forwards them into a collection station 60.

Figure 2:
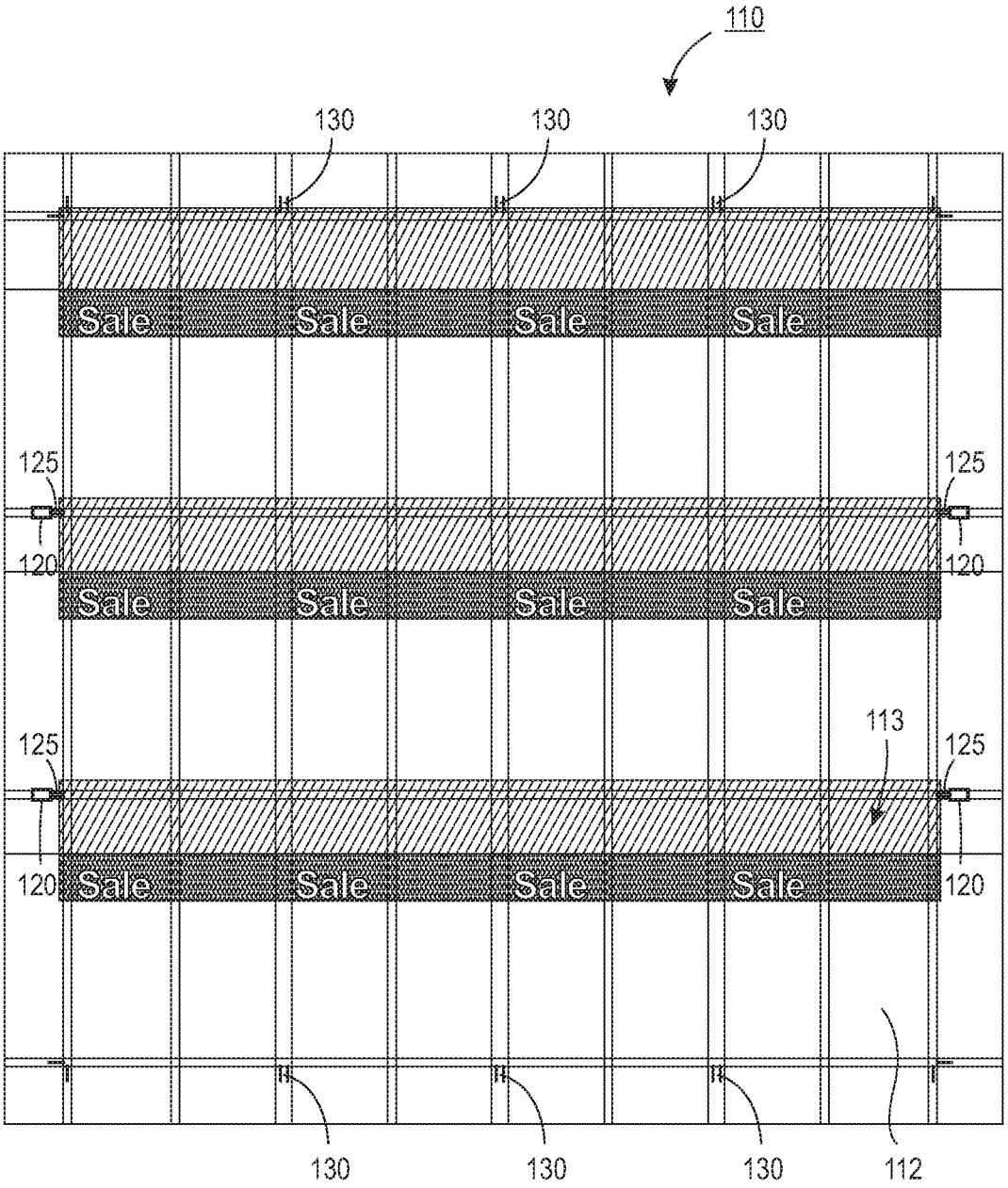
FIG. 2 is a plan view of a polymer lined fully backed adhesive signage media containing column and row gutter placements therein.
Figure 3A:
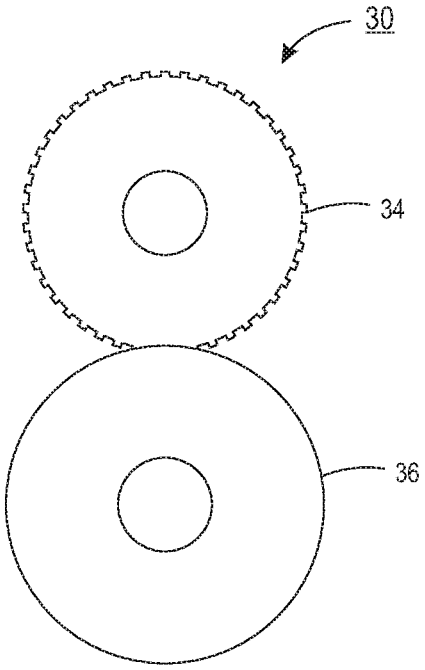
FIG. 3A is side view of a cutter with a blade that has been moved into a groove and cutting position within a mating member and in FIG. 3B the cutting blade has been moved into a non-cutting position with respect to the mating member.
Figure 3B:
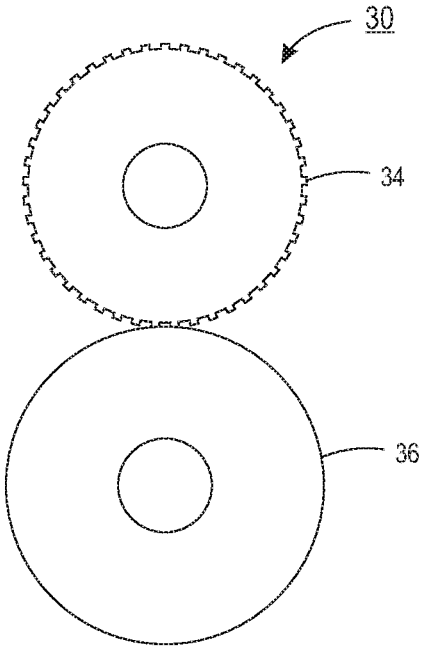
Figure 4:
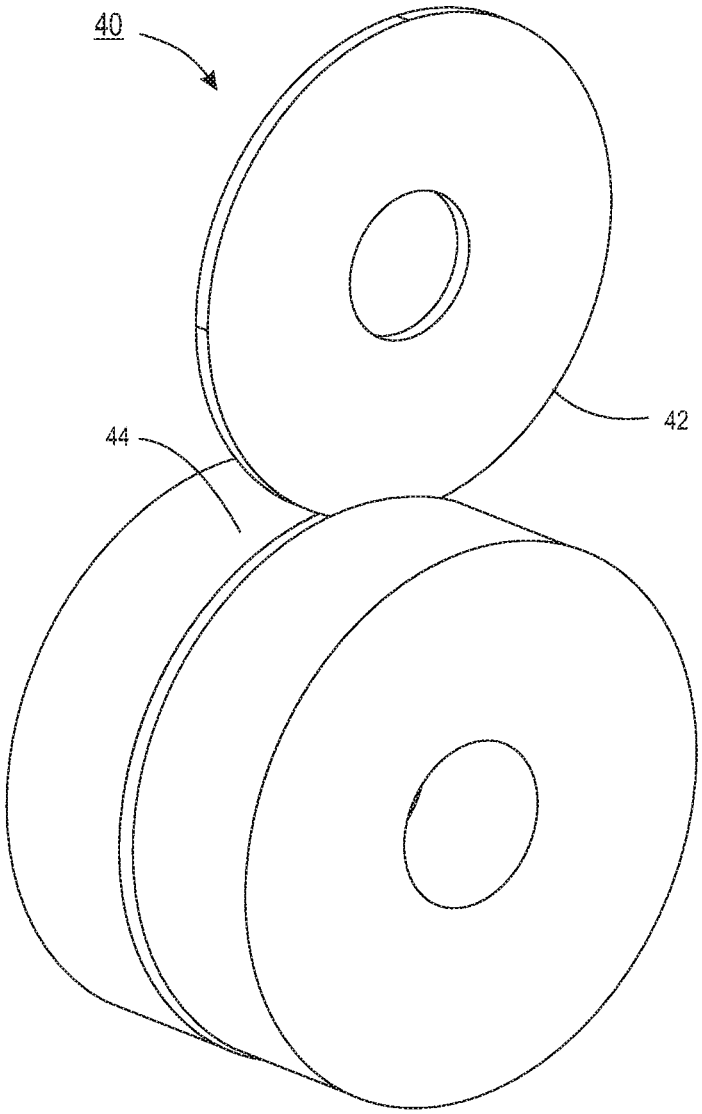
FIG. 4 is side views of a cutter with a stationary positioned rotary blade inserted into a groove and cutting position in a stationary positioned rotary mating member.

FIG. 2 is a schematic top view illustration of multilayer substrate 110 that includes paper 112, adhesives (not shown) and a polymer carrier 113 and release liner (not shown). Cutting multilayer substrate 110 into multiple cards for placement onto store shelving is sometimes met with cutting issues when blades of the cutting equipment varies from their optimal nominal states due to thicker polymer carrier, thicker paper, more adhesive, dulling blades or blade spacing. Substrate 110 includes orthogonal row gutters 125 for access by articulable first cutter 30 and in-line column gutters 130 to be accessed by stationary second cutter 40. Die cuts 120 are placed at the leading and trailing edges of the substrate in order for the slitter blades of the first cutters to cut strips up to the point of the die cuts 120 and this will facilitate a clean cut. As shown in FIG. 3A, conventional cutter 30 includes a rotary blade 34 that has been moved into a groove in stationary rotating member 36 for engagement with substrate 110 of FIG. 2 orthogonal to a lengthwise dimension of the substrate and is lifted away from the substrate as shown in FIG. 3B after slitting gutter 125. A second conventional cutter 40 in FIG. 4 includes a stationary rotating blade 42 positioned to extend into a groove in mating member 44 in order to cut through the bottom of the substrate 110 in-line with a lengthwise dimension of the substrate and the resulting separate cards 114 from the cutting are then forwarded into separate bins at collection station 60. Blade 42 is met with enhanced resistance when in-line column gutter cutting is initiated in non-rigid, flexible and unsupported polymer carrier 113 and release liner portion of the substrate where a previous orthogonal cut has been made preventing cards 114 from completely separating at the blade entry point. Occasionally, this results in some cards remaining adhered to or not fully separated from the adjacent gutter after the secondary cutting operation and if delivered to the collection station in this state jams can be created in separate bins of the collection station.

Figure 5:
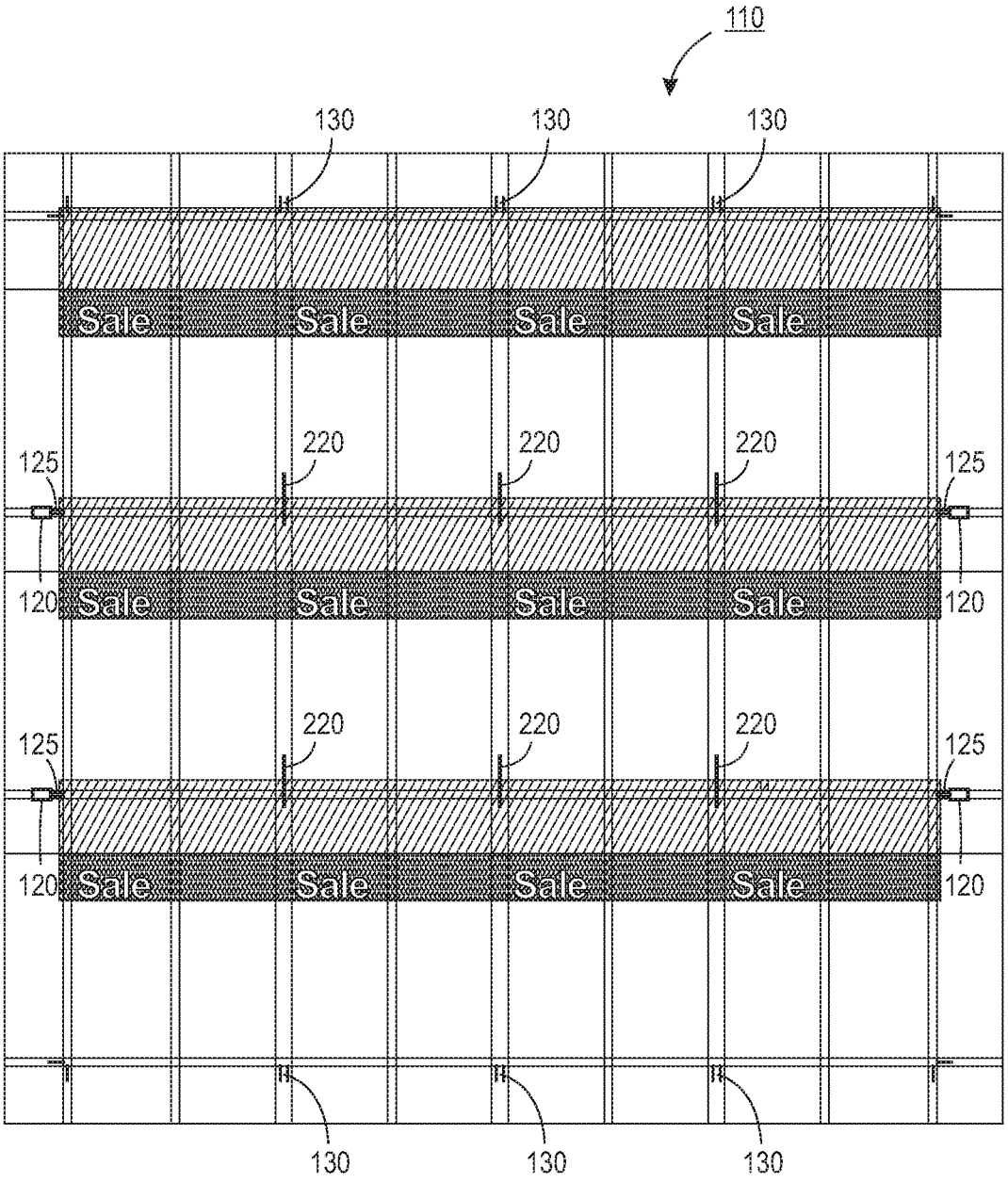
FIG. 5 is a plan view of a polymer lined fully backed adhesive signage media containing column and row gutter placements with pre-die cut slit placements therein at secondary cut stress concentration points.

To counter the heretofore-mentioned gutter cutting issues and in accordance with the present disclosure, FIG. 5 is shown that includes placing pre-die-cut slits 220 at projected difficult to cut points in substrate 110 in the bottom of the substrate to create a pre-arranged stress concentration point needed to ensure that polymer carrier 113 of substrate 220 is completely slit by stationary cutter 40 and the cards cut from the substrate are removed effectively from each other prior to being transported to the collection tray 60. By placing pre-die-cut slits 220 at the bottom of each card in the ⅛" gutter and creating a stress concentration point, difficulty in cutting at the flexible polymer carrier/release liner flexible unsupported points created where the in-line cuts intersect with previous orthogonal cuts is addressed while the blade 42 initiated portion of the cut is simultaneously backed up by the pre-die-cut slits thereby ensuring that if the gutter blade fails to initiate a clean cut at the bottom of the card, the pre-die-cut slit will ensure that there is still a full separation between each card and gutter at the pre-die-cut. Pre-die-cut slits 220 in substrate 110 are preferably positioned to extend through an upper end of one card and into a bottom portion of another card above it. The pre-die-cut slits will create a stress concentration in substrate 110 to allow stationary rotary cutter 40 to consistently cut the cards from bottom to top lengthwise when there is the flexible initial area in polymer carrier 113 caused by the previous gutter cut made by articulating cutter 30.

In recapitulation, a method for improved separation of individual signs cut from multilayer substrates includes placing pre-die-cut slits in gutter areas of the signs. The pre-die-cut slits compensate for cutting difficulties created at the bottom of the signs where there is a flexible unsupported polymer carrier and release liner in the signs produced by gutter cutting the signs first in a widthwise direction and then when it is subsequently necessary to cut the signs in a lengthwise direction during the second fixed rotary cutting operation. The pre-die-cut slits align with the gutter cutting operation in the lengthwise direction. This ensures that when the signs go through the gutter cutting blades the signs and adjacent gutter will separately cleanly from each other every time even if the gutter blades fail to fully cut at the bottom of the signs.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for cleanly separating cards cut from adhesive signage for store shelving, comprising:

providing separate and individual sheets of adhesive signage with each of said individual and separate sheets having column and row gutters;

providing prearranged longitudinal slits within said column gutters;

placing each of said separate and individual sheets of adhesive signage onto a conveyor belt;

providing a first cutter, said first cutter including a rotary blade;

feeding said separate and individual sheets of adhesive signage into said first cutter for cutting said sheets of adhesive signage along said row gutters;

moving said rotary blade into a groove in a stationary member for engagement with said separate and individual sheets of adhesive signage;

lifting said rotary blade away from said groove of said stationary member after cutting each of said row gutters;

providing a second cutter and aligning said second cutter with said prearranged longitudinal slits and cutting said separate and individual sheets of adhesive signage along said column gutters and through said prearranged longitudinal slits;

and using said prearranged longitudinal slits to create stress concentration points in said separate and individual sheets of adhesive signage in order to back up blade initiated portions of said cutting of said separate and individual sheets of adhesive signage along said column putters such that if said blade initiated portions of said cutting of said separate and individual sheets of adhesive signage along said column gutters fails to initiate a clean cut at a bottom of said cards said prearranged longitudinal slits will ensure full separation between said separate and individual sheets of adhesive signage and said gutter columns by said second cutter at said prearranged longitudinal slits.

2. The method of claim 1, wherein said prearranged longitudinal slits in said separate and individual sheets of adhesive signage are between cards on said separate and individual sheets of adhesive signage.

3. The method of claim 2, wherein said second cutter has blades adapted to cut through a bottom surface of said separate and individual sheets of adhesive signage within said column gutters to create multiple cards.

4. The method of claim 1, including cutting said separate and individual sheets of adhesive signage with said second cutter in a direction orthogonal to cuts provided in said separate and individual sheets of adhesive signage by said first cutter.

5. The method of claim 1, including providing said prearranged longitudinal slits in each of said separate and individual sheets of adhesive signage as a first cut before said separate and individual sheets of adhesive signage reach said first cutter.

6. The method of claim 1, wherein first cutter provides second cuts to said separate and individual sheets of adhesive signage.

7. The method of claim 6, wherein said second cutter provides third cuts to said separate and individual sheets of adhesive signage.

* * * * *